US011207718B1

(12) United States Patent
Gumbs Martin

(10) Patent No.: US 11,207,718 B1
(45) Date of Patent: Dec. 28, 2021

(54) METHOD AND APPARATUS FOR CLEANING FALSE EYELASHES

(71) Applicant: Tara Dominique Gumbs Martin, Albuquerque, NM (US)

(72) Inventor: Tara Dominique Gumbs Martin, Albuquerque, NM (US)

( * ) Notice: Subject to any disclaimer, the term of this patent is extended or adjusted under 35 U.S.C. 154(b) by 0 days.

(21) Appl. No.: 17/156,582

(22) Filed: Jan. 24, 2021

Related U.S. Application Data

(60) Provisional application No. 62/965,296, filed on Jan. 24, 2020.

(51) Int. Cl.

| | |
|---|---|
| ***B08B 11/02*** | (2006.01) |
| ***B08B 3/04*** | (2006.01) |
| ***B08B 3/02*** | (2006.01) |
| *A41G 5/02* | (2006.01) |

(52) U.S. Cl.
CPC ..... *B08B 11/02* (2013.01); *B08B 3/02* (2013.01); *B08B 3/047* (2013.01); *A41G 5/02* (2013.01)

(58) Field of Classification Search
CPC ..... A41G 5/02
See application file for complete search history.

(56) References Cited

U.S. PATENT DOCUMENTS

| | | | |
|---|---|---|---|
| 3,333,593 | A | 8/1967 | McGivern |
| 3,491,775 | A | 1/1970 | Aylott |
| 3,504,682 | A | 4/1970 | Aylott |
| 3,644,955 | A | 2/1972 | Mackiernan |
| 3,645,277 | A | 2/1972 | McCarthy |
| 5,388,686 | A | 2/1995 | Kanner et al. |
| 5,759,540 | A | 6/1998 | Nielsen |
| 6,148,992 | A | 11/2000 | Kanner et al. |
| 9,913,506 | B2 | 3/2018 | Hansen et al. |
| 10,264,837 | B2 | 4/2019 | Park |
| 2014/0110304 | A1 | 4/2014 | Wu et al. |
| 2018/0352886 | A1 | 12/2018 | Schroeder et al. |

*Primary Examiner* — Mikhail Kornakov
*Assistant Examiner* — Ryan L Coleman
(74) *Attorney, Agent, or Firm* — Santa Fe IP, LLC

(57) ABSTRACT

An apparatus for cleaning false lashes for includes a body having upper and lower supports, each including a plurality of apertures, that are movable relative to one another between open and closed positions, the open position providing access to an inner surface of the lower support, and the closed position substantially abuts the upper and lower supports against one other, and an arcuate locator on an inner surface of the lower support that positions a strip of a false lash such that strands of the false lash extend across at least one aperture. The false lash is secured between the upper and lower supports in the closed position. Running fluid through the apertures of the upper and lower supports allows the fluid to run through the strands of the false lash. A system and methods of cleaning false lashes is also disclosed.

20 Claims, 8 Drawing Sheets

METHOD AND APPARATUS FOR CLEANING FALSE EYELASHES

CROSS-REFERENCES TO RELATED APPLICATIONS

This application claims priority to U.S. Provisional Patent Application No. 62/965,296 filed Jan. 24, 2020 and entitled METHOD AND APPARATUS FOR CLEANING FALSE EYELASHES, the entire contents of which is incorporated herein by this reference.

BACKGROUND OF INVENTION

Field of Invention

This application relates to methods and apparatuses for cleaning false lashes.

Description of Related Art

Faux eyelashes have quickly become a mainstay in the makeup routines of many. While lash extensions can look great, many opt for false lashes because they do not require the time and expense of professional application. Also, lash extensions are semi-permanent—false lashes allow a person to vary their appearance daily, for example, going with a natural look one day, and a full glamour look the next.

Another advantage of false lashes is they can be reused. However, the process of cleaning false lashes may be cumbersome and time consuming. Without proper cleaning, reuse of unsanitary false lashes may lead to possible eye irritation and/or infection. And without proper care, false lashes may wear prematurely thus requiring frequent purchase and replacement.

It would therefore be useful to provide methods and apparatuses for easily cleaning false lashes while keeping the integrity of the lashes, thus allowing for repeated, longer use of purchased false lashes.

BRIEF SUMMARY

One aspect of the present invention is directed to an apparatus for cleaning false lashes, each false lash having strands extending from a strip, the apparatus includes: a body including an upper support and a lower support, each support including a plurality of apertures, wherein the upper and lower supports are movable relative to one another between open and closed positions, wherein the upper support is opened from the lower support to provide access to an inner surface of the lower support in the open position, and wherein the upper and lower supports substantially abut against one other in the closed position; and an arcuate locator on an inner surface of the lower support, wherein the locator positions a strip of a false lash on the lower support such that strands of the false lash extend across at least one of the plurality of apertures; wherein the false lash is secured between the upper and lower supports when the upper and lower supports are in the closed position, and wherein running fluid through the apertures of the upper and lower supports allows the fluid to run through the strands of the false lash.

The apparatus may further include a plurality of arcuate locaters projecting from an inner surface of the lower support, wherein the plurality of locaters position the respective strips of one or more pairs of false lashes on the lower support so that corresponding strands of the false lashes extend across at least a corresponding one of the plurality of apertures.

The locater may be an arcuate rib projecting from the inner surface of the lower support.

At least one of the plurality of apertures in the upper support may be arcuate, and wherein the arcuate rib of the lower support may extend into said at least one arcuate aperture of the upper support when the upper and lower supports are in the closed position.

The lower support may include a recess having an arcuate wall surface, and wherein the arcuate wall surface is the arcuate locater.

The recess may be substantially fan-shaped and dimensioned to receive an entire false lash, and wherein the upper support includes a substantially fan-shaped projection that extends into the substantially fan-shaped recess of the lower support to trap the false lash therein when the upper and lower supports are in the closed position.

The one or more of the plurality of apertures may extend across the fan-shaped recess, and wherein another one or more of the plurality of apertures extend across the fan-shaped projection.

The apparatus may further include a hinge interconnecting the upper and lower supports, whereby the upper support pivots open relative to the lower support when going from the closed position to the open position.

A first portion of the hinge may be monolithically formed with the lower support, and a second portion of the hinge may be monolithically formed with the upper support.

The apparatus may further include a handle including a lower member extending from the lower support and an upper member extending from the upper support, wherein the upper and lower members substantially rest against one other when the upper and lower supports are in the closed position.

The lower member may be monolithically formed with the lower support, and the upper member may be monolithically formed with the upper support.

The handle may include a coupling to engage the upper and lower members together when the upper and lower supports are in the closed position.

The coupling may be a magnetic coupling with at a magnet mounted in at least one of the upper and lower members.

The apparatus may further include an arcuate holder extending from an inner surface of the upper support, wherein the holder is immediately proximate the locator when the upper and lower supports are in the closed position to press the strip of the false lash against the inner surface of the lower support an releasably secure the false lash relative to the upper and lower supports, whereby the strip of the false lash does not move relative to the upper and lower supports when running fluid through the apertures of the upper and lower supports.

Each of the plurality of apertures may be arcuately shaped.

Each of the plurality of apertures may be concentrically arranged with respect to one another.

The plurality of apertures may include two or more sets of apertures, each set of apertures including a plurality of concentrically arranged apertures, and each set of apertures corresponding to a respective false lash.

Another aspect of the present invention is directed to a method for cleaning false lashes, each false lash having strands extending from a strip, the method may include: opening an eyelash cleaning apparatus, the apparatus including a body having an upper support and a lower support, and each support having a plurality of apertures, wherein the upper and lower supports are movable relative to one another between open and closed positions; placing a false lash on an inner surface of the lower support such that the strip of the false lash is positioned against an arcuate locator on the inner surface of the lower support and strands of the false lash extend across at least one of the plurality of apertures; closing the eyelash cleaning apparatus and wherein the upper and lower supports substantially abut against one other such that the false lash is secured between the upper and lower supports when the upper and lower supports are in the closed position; and running fluid through the apertures of the upper and lower supports allows the fluid to run through the strands of the false lash.

A further aspect of the present invention is directed to a system for cleaning false lashes, each false lash having strands extending from a strip, the system may include: a cleaning chamber configured for receiving one or more false lashes; one or more clips extending from an inner surface of the cleaning chamber, each clip configured to releasably secure one or more false lashes within the cleaning chamber; and one or more nozzles for directing fluid within the cleaning chamber toward the one or more false lashes secured to the one or more clips; wherein the nozzles direct fluid against the one or more false lashes to clean or rinse the false lashes secured to the one or more clips.

The system may further include a lash cleaner having: a body having an upper support and a lower support, each support including a plurality of apertures, wherein the upper and lower supports are movable relative to one another between open and closed positions, wherein the upper support is opened from the lower support to provide access to an inner surface of the lower support in the open position, and wherein the upper and lower supports substantially abut against one other in the closed position; and an arcuate locator on an inner surface of the lower support, wherein the locator positions a strip of a false lash on the lower support such that strands of the false lash extend across at least one of the plurality of apertures; wherein the one or more clips are configured to secure the body within the cleaning chamber; and wherein the one or more nozzles are configured to spray fluid against the body such that the fluid runs through the apertures of the upper and lower supports and through the strands of the false lash.

The one or more nozzles may be angled to direct fluid obliquely within the cleaning chamber to create a whirlpool flow of fluid within the cleaning chamber.

Still another aspect of the present invention is directed to a method for cleaning false lashes, each false lash having strands extending from a strip, the method may include: securing a false lash into a system for cleaning false lashes, the system including a cleaning chamber configured for receiving one or more false lashes, and one or more clips extending from an inner surface of the cleaning chamber, each clip configured to releasably secure one or more false lashes within the cleaning chamber; and running fluid against the false lase and through the strands of the false lash, the system including one or more nozzles for directing fluid within the cleaning chamber toward the one or more false lashes secured to the one or more clips; wherein the nozzles direct fluid against the one or more false lashes to clean or rinse the false lashes secured to the one or more clips.

The method may further include: placing the eyelash into a lash cleaner, wherein the lash cleaner includes a body having an upper support and a lower support, each support including a plurality of apertures, wherein the upper and lower supports are movable relative to one another between open and closed positions, wherein the upper support is opened from the lower support to provide access to an inner surface of the lower support in the open position, and wherein the upper and lower supports substantially abut against one other in the closed position, and the lash cleaner further includes an arcuate locator on an inner surface of the lower support, wherein the locator positions a strip of a false lash on the lower support such that strands of the false lash extend across at least one of the plurality of apertures; wherein the securing is accomplished by securing the body of the lash cleaner into the system with the lash positioned within the body, wherein the one or more clips are configured to secure the body within the cleaning chamber; and wherein the one or more nozzles are configured to spray fluid against the body such that the fluid runs through the apertures of the upper and lower supports and through the strands of the false lash.

The methods and apparatuses of the present invention have other features and advantages which will be apparent from or are set forth in more detail in the accompanying drawings, which are incorporated herein, and the following Detailed Description, which together serve to explain certain principles of the present invention.

BRIEF DESCRIPTION OF THE DRAWINGS

FIG. 4 is a cross-sectional view of the apparatus of FIG. 1 taken along line 4-4 in

FIG. 3.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention (s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 1:
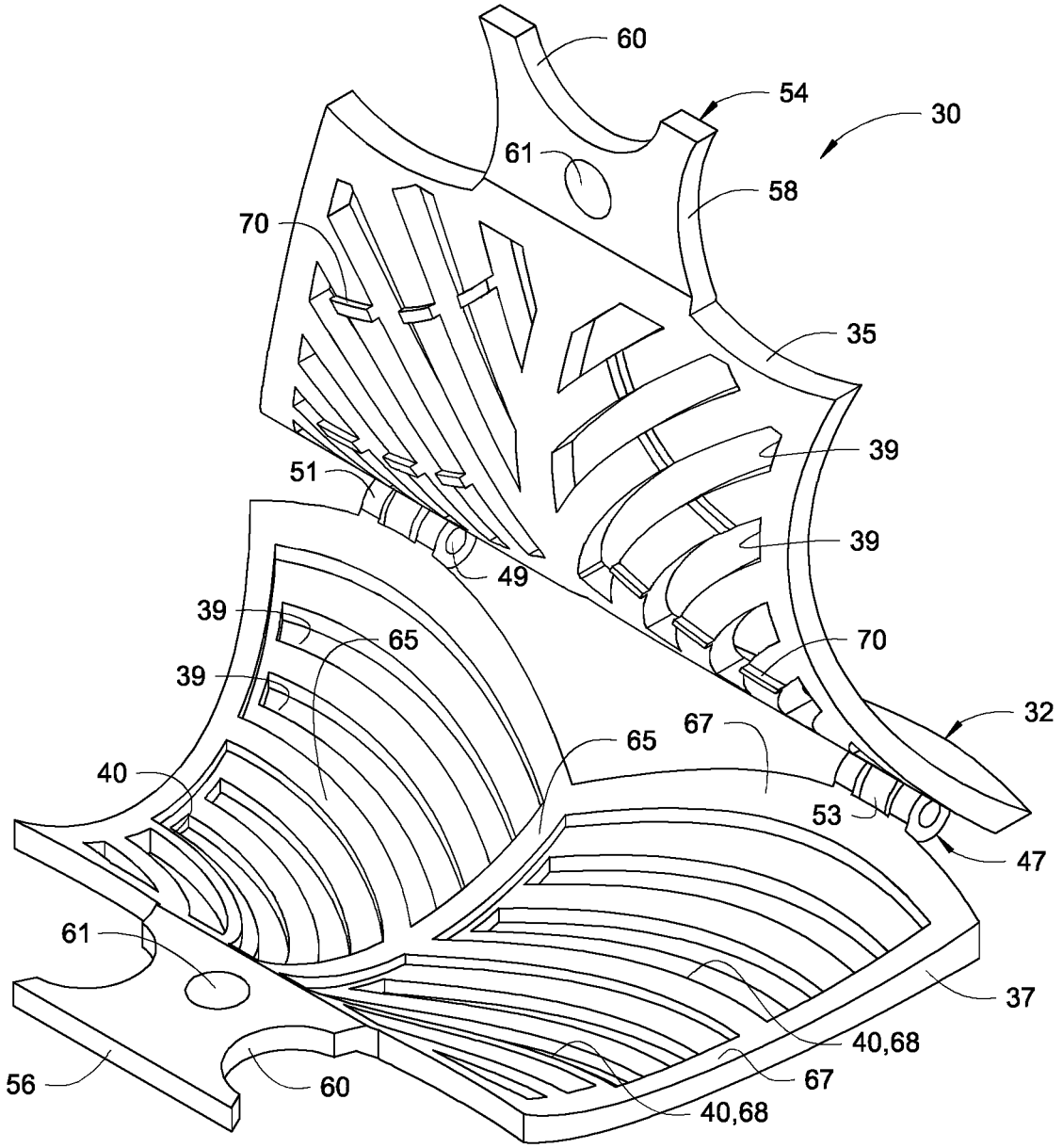
FIG. 1 is a perspective view of an apparatus for cleaning false lashes in accordance with various aspects of the present invention.

Turning now to the drawings, wherein like components are designated by like reference numerals throughout the various figures, attention is directed to an exemplary lash cleaner 30 shown in FIG. 1. Generally, the lash cleaner includes a body 32 that supports false lashes 33 for cleaning (see FIG. 2). The body includes upper and lower supports 35, 37 that are movable relative to one another between open (FIG. 2) and closed positions (FIG. 5) to receive the false lashes, and to secure the false lashes with minimal movement of the false lashes within the lash cleaner. The supports include a plurality of apertures 39 that allow fluid to pass therethrough for cleaning false lashes positioned therein. And at least one support includes a locator 40 to properly position each false lash such that water, soap, makeup remover and/or other fluid may pass through the apertures and to clean the strip 42 and strands 44 of the false lashes positioned therein. One may then set aside the lash cleaner to allow the false lashes to dry therein.

With reference to FIG. 1, body 32 is sized to hold several false lashes at once. For example, the body may measure approximately 4¼ inches wide by 3¾ inches high by ½ inch thick and be configured to hold two pairs of false lashes. One will appreciate that the dimensions and configuration may vary to accommodate various false lashes of differing shapes, sizes and quantities.

Body 32 includes upper and lower supports 35, 37, that move relative to another between an open position (FIG. 2) that provides access to an inner surface 46 of the lower support, and between a closed position (FIG. 5) in which the upper and lower supports substantially abut against one another. While the terms "upper" and "lower" are used with reference to the positions of the supports as displayed in the drawing figures, one will appreciate that the body is equally suited for use in both an upright orientation (FIG. 6) or an inverted orientation, an upside-down vertical orientation (FIG. 7), angled or inclined orientations (FIG. 8 and FIG. 9), as well as other orientations in which a user may comfortably grab, maneuver, and use the lash cleaner.

Figure 5:
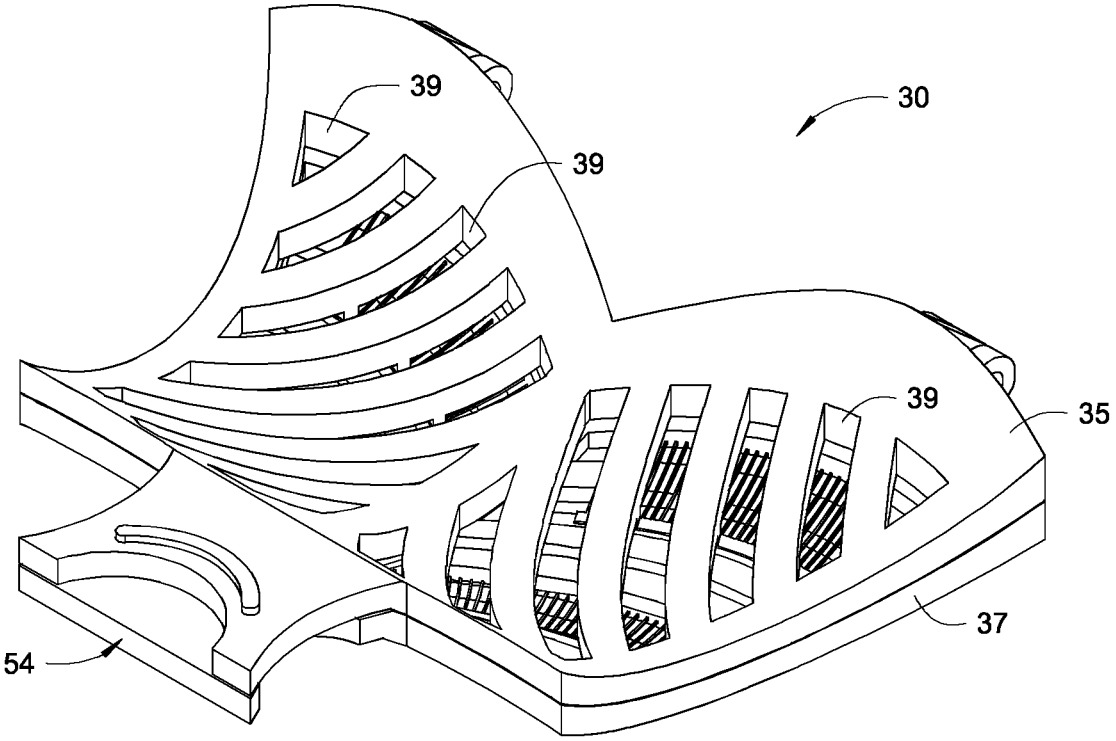
FIG. 5 is a perspective view of the apparatus of FIG. 1, with false lashes placed therein, in a closed position.

In various embodiments, the upper and lower supports 35, 37 pivot relative to one another about a hinge 47 in a clamshell-like manner between an open position (FIG. 2) and a closed position (FIG. 5). In the illustrated embodiment, the hinge includes a hinge pin 49 interconnecting a first portion 51 monolithically formed with lower support 37 and sandwiching a second portion 53 monolithically formed with upper support 35. One will appreciate that various embodiments may utilize other suitable hinge configurations. For example, a pin may be monolithically formed with one of the hinge portions and telescopically received in the other of the hinge portions.

One will also appreciate that the upper and lower supports may be otherwise moveable relative to one another between open and closed positions. For example, the supports may be otherwise tied together and/or wholly separable from one another, such that the body may be readily opened providing access to its inner surfaces as will become apparent below.

Body 32 also includes a handle 54 to facilitate a user in opening, closing, and otherwise handling lash cleaner 30. The handle includes a lower member 56 extending from lower support 37 and an upper member 58 extending from upper support 35 such that the upper and lower members substantially rest against one other when the upper and lower supports are in the closed position (FIG. 5).

In various embodiments, lower member 56 is monolithically formed with lower support 37, and upper member 58 is monolithically formed with upper support 35. While a monolithic configuration may simplify manufacturing and reduce part count and costs, one will appreciate that the handle members may be separate components affixed to the respective supports in an otherwise conventional manner.

Preferably, the handle is dimensioned to facilitate a user in gripping the lash cleaner as well as opening and closing upper and lower supports of the lash cleaner. For example, the handle may measure approximately 1¾ inch wide by 1¼ inch high. Again, one will appreciate that the dimensions of the handle may vary. To further ease opening of the upper and lower supports, the upper and lower members may include indentations 60 to allow a user to separately grasp and pull apart the upper and lower handle members 58, 56 in order to open the body.

Figure 2:
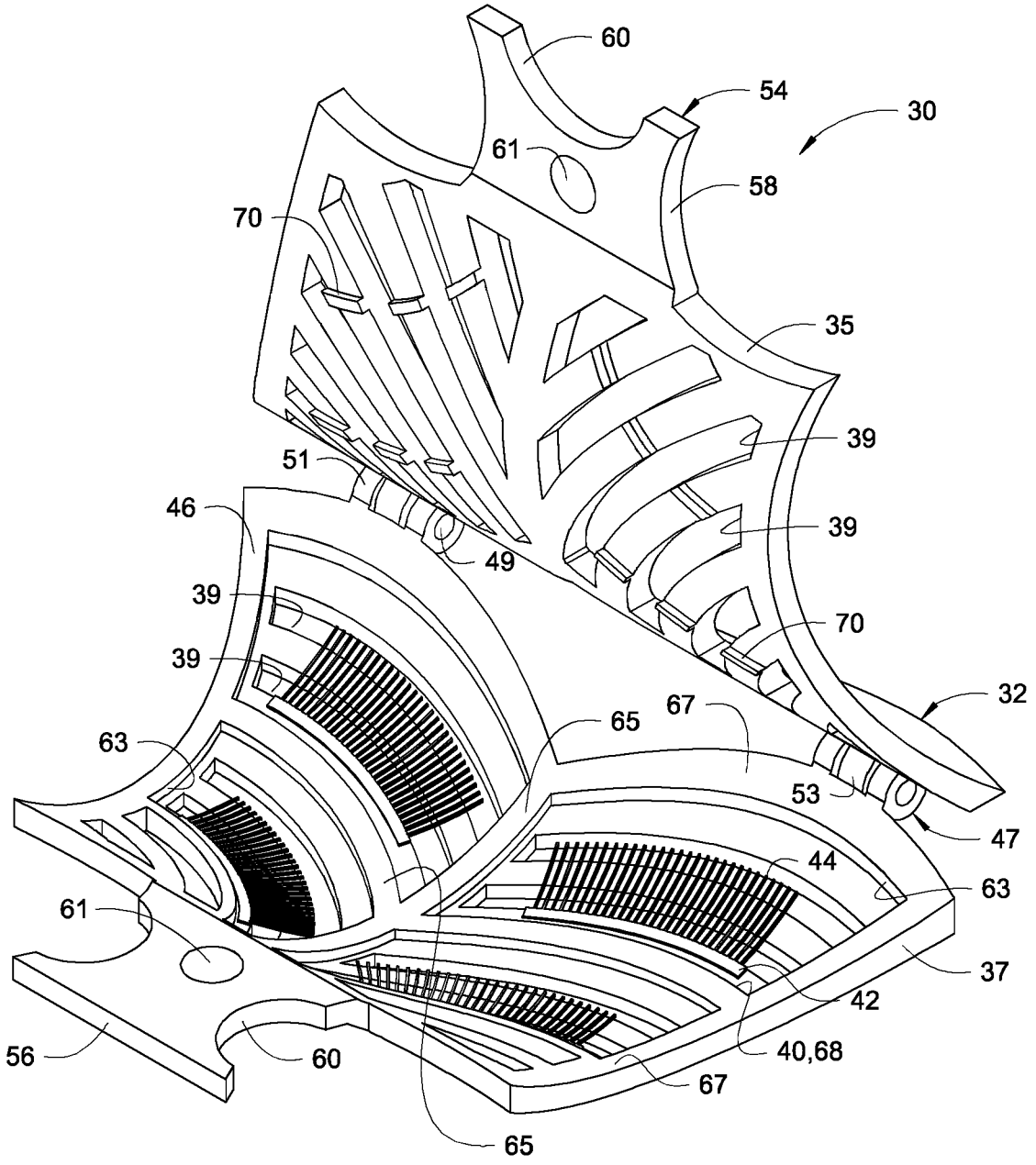
FIG. 2 is a perspective view of the apparatus of FIG. 1 with false lashes placed therein.
Figure 3:
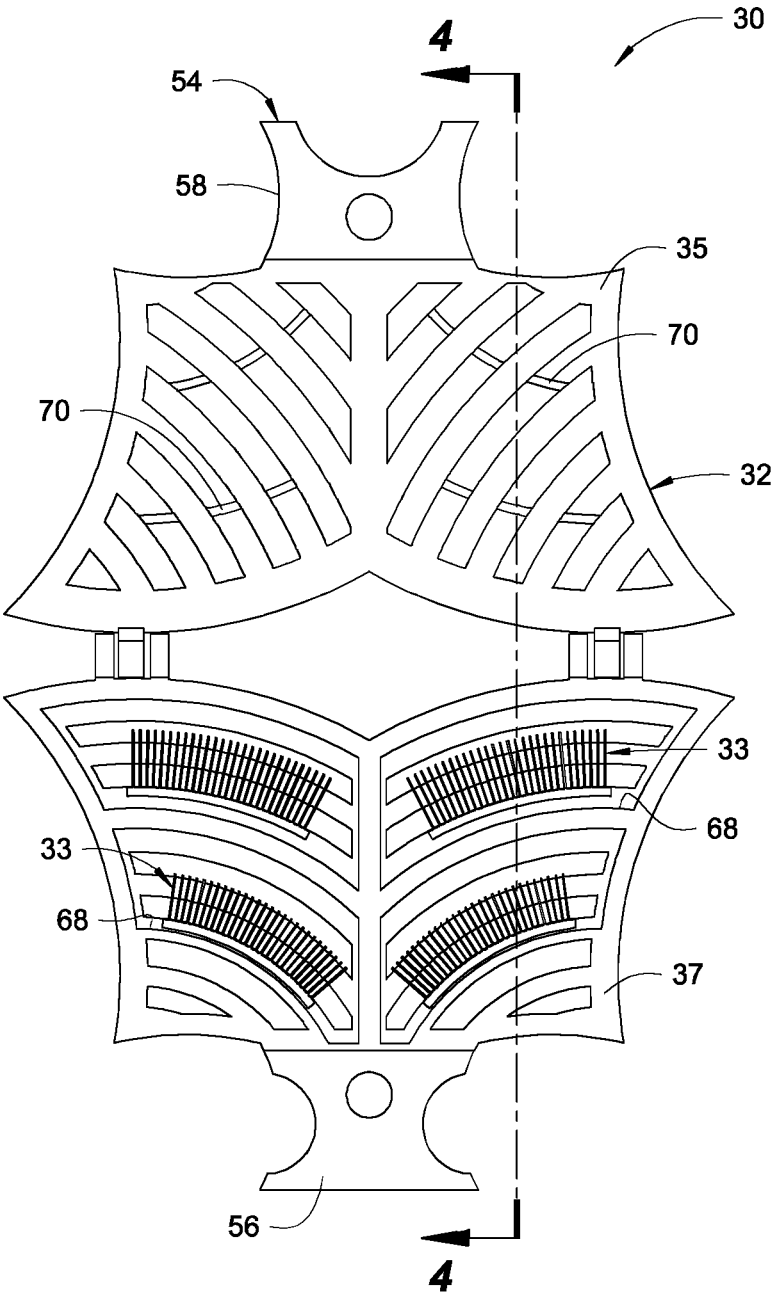
FIG. 3 is a plan view of the apparatus of FIG. 1 with false lashes placed therein.
Figure 4:
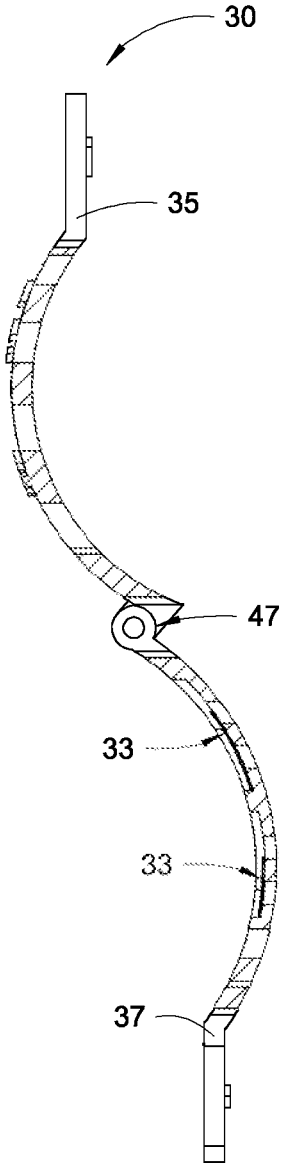

In various embodiments, the handle includes a coupling 61 that releasably secures the upper and lower members 58, 56 together when the upper and lower supports 35, 37 are in the closed position as shown in FIG. 5. The coupling may be a magnetic coupling in which magnets are mounted in each of the upper and lower members are arranged such that opposing polarities securely hold the members against one another to hold the upper and lower supports in their closed position (FIG. 5), while allowing a user to separately grasp the upper and lower members to pull them apart to open the upper and lower support to their opened position (FIG. 2). Alternatively, a magnet may be provided on one member, and a ferromagnetic material such as iron or steel on the other member. Further still, a mechanical clasp or latch may be utilized to releasably hold the upper and lower members together.

The upper and lower supports 35, 37 each include a plurality of apertures 39 that allow fluid to pass therethrough for cleaning false lashes 33. In various embodiments, the apertures may be arcuate such that they mimic the shape of a false lash (see, e.g., lower support 37 in FIG. 2, and both upper and lower supports 35*a*, 37*a* in FIG. 10). Arranging arcuate apertures concentrically with one another provides an aesthetically pleasing design while providing a sufficient supporting surface to support a false lash on the lower support in the open position, and within the body in its closed position.

Figure 10:
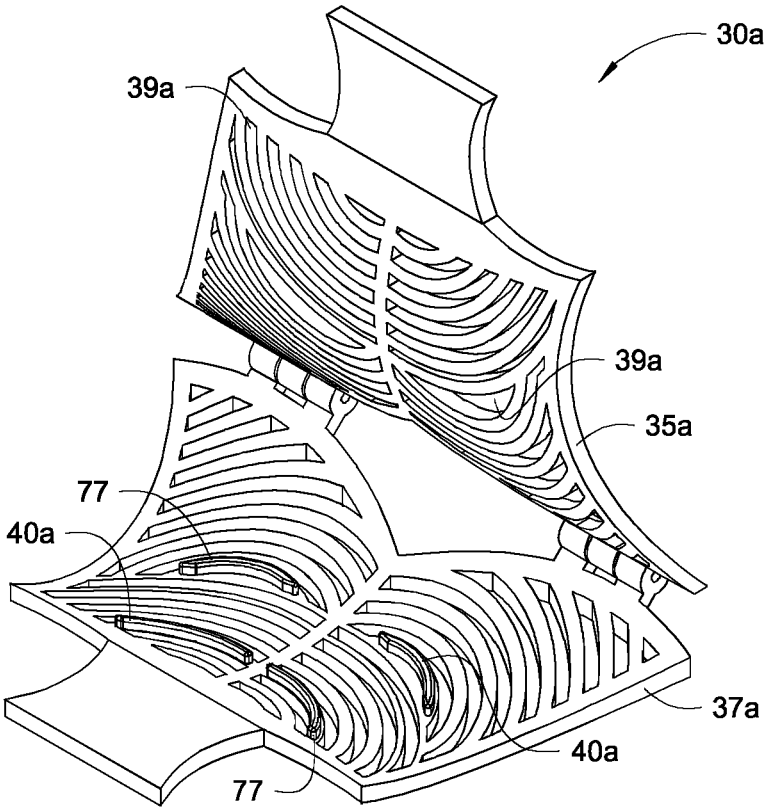
FIG. 10 is a perspective view of another apparatus for cleaning false lashes in accordance with various aspects of the present invention.

The apertures of the upper and lower supports may extend parallel to one another as shown in FIG. 10, or the apertures may extend perpendicularly or obliquely to one another as shown in FIG. 2. Advantageously, perpendicular and oblique configurations provide for a "mesh" design that may facilitate holding false lashes in place between the upper and lower supports.

Figure 12:
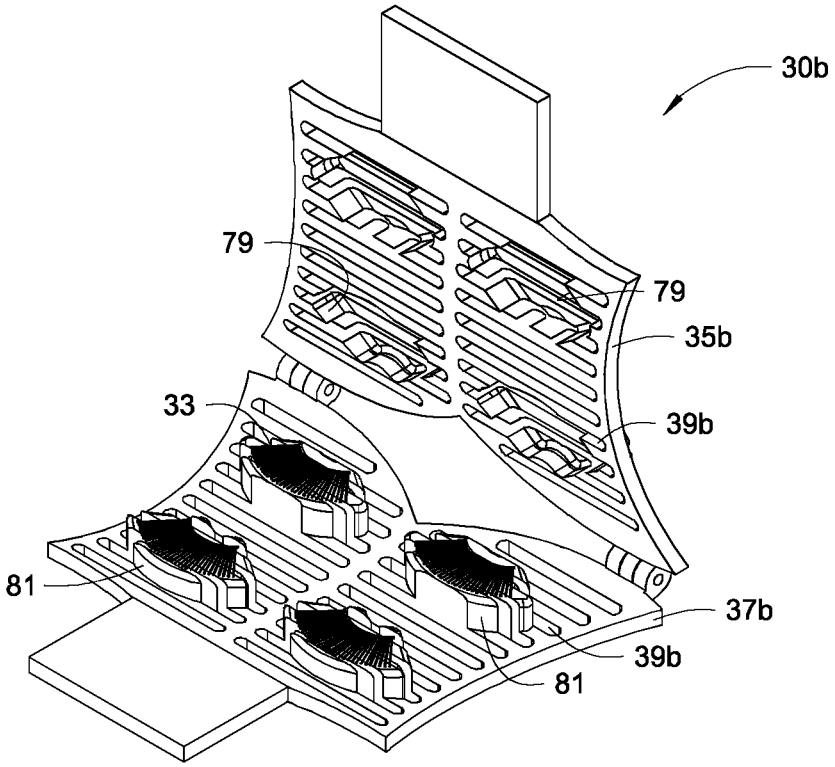
FIG. 12 is a perspective view of another apparatus for cleaning false lashes in accordance with various aspects of the present invention.

In various embodiments, apertures 39*b* may extend in parallel lines across the supports (see, e.g., FIG. 12). Alternatively, the apertures may have other shapes such as circles, triangles, squares. The apertures may have polygonal shapes and/or organic shapes, and the apertures may be any mix of shapes (e.g., arcuate and linear). Regardless of the shape or orientation, the apertures should be configured to allow fluid to pass through the upper and lower supports when they are in their closed position.

In the case of slotted or elongated apertures, the slots should be relatively narrow such that a false lash does not inadvertently pass through the slot. One will appreciate that a screen or mesh may be mounted on one or both supports to provide suitable apertures that allow fluid to pass through while holding the false lashes in place.

In various embodiments, lower support 37 includes one or more lash recesses 63 that are configured and dimensioned to receive individual false lashes. The recesses may simply be areas of the lower support that are recessed downwardly from inner surface 46 of the lower support. The recesses may be thinned areas of the lower support extending between thicker spines 65 and peripheral ribbing 67, with the thinned areas creating the recesses for receiving false lashes, and the spines and ribbing providing reinforced structure to strengthen and provide structural integrity to the lower support.

Each of the lash recesses may be similarly sized and have the ability to accommodate large, medium and small lashes of various lengths and thicknesses. One will appreciate, however, that the lower support may include lash recess of different sizes and configurations, for example, to accommodate various types of false lashes including clusters, strips, and/or magnetic lashes.

The recesses may include an arcuate wall surface 68 that forms locator 40 to properly position false lash 33 on the lower support such that its strands 44 extend across an aperture 39 to facilitate washing. In particular, a user may position the concave edge of a false lash strip 42 immediately proximal or abutting against the wall surface, which in turn positions the strands of the false lash across one or more adjacent apertures.

In various embodiments, upper support 35 may include an arcuate holder 70 that protrudes downwardly from the inner surface of the upper support. The holder is configured to be immediately proximate locator 40 when the upper and lower supports are in the closed position such that it presses strip 42 of the false lash against the lower support to releasably hold and secure the false lash between the upper and lower supports. With the strip of the false lash pinched between the holder and the lower support, the false lash cannot move relative to the upper and lower supports, and thus fluid running through the apertures of the upper and lower supports will also run through the strands of the false lash without moving the false lash relative to the upper and lower supports, and without inadvertently pushing the false lash through an aperture.

In the illustrated embodiment, holder 70 is a segmented protrusion that extends across several apertures, and its segmented configuration does not obstruct fluid flowing through the apertures. One will appreciate, however, that the holder may be a continuous protrusion that extends continuously across multiple apertures, or the holder may be a segmented protrusion or a continuous protrusion that runs along the upper support between adjacent apertures.

In various embodiments, each of the upper and lower supports are monolithically formed with their respective hinge portions, handle members, and other componentry including the locator, holder, etc. The supports may be formed by injection molding, 3D printing, casting, and/or other suitable means. Preferably, the supports are formed of a light yet durable plastic material such as nylon, polycarbonate, polyethylene, polypropylene, acrylonitrile butadiene styrene (ABS), and/or other suitable materials. One will appreciate that the supports may be formed of other rigid or semi-rigid materials such as aluminum, stainless steel, titanium and other metals. As mentioned above, a screen or mesh may be incorporated into the supports to provide the apertures, which screen or mesh may be formed of stainless steel or other suitable material compatible with various cleaning and/or makeup removal agents.

Figure 6:
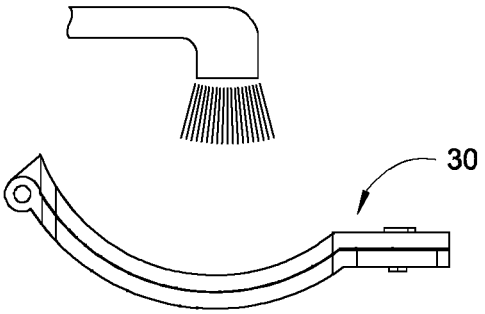
FIG. 6 is a schematic view of an exemplary method to clean false lashes.
Figure 7:
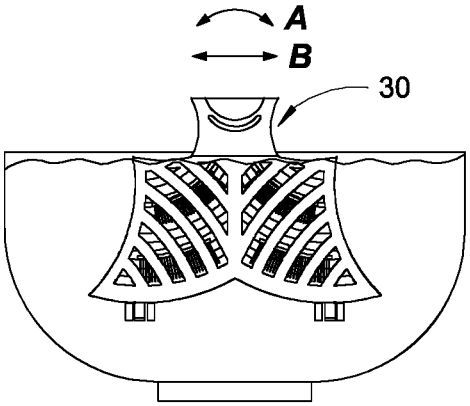
FIG. 7 is a schematic view of another exemplary method to clean false lashes.

With one or more false lashes 33 positioned in one or more respective recesses 63, body 32 may be closed such that the inner surfaces of upper and lower supports 35, 37 are substantially abutting against one another thus enclosing and securing the false lashes within the recesses. With the false lashes thus secured, a user may then hold lash cleaner 30 under running water to rinse the false lash as shown in FIG. 6. Or the user may swish and/or agitate lash cleaner 30 in an open container filled with water, soap, makeup remover and/or other cleaning or cleansing fluid (or combination thereof) to clean and/or rinse the false lashes as shown in FIG. 7. Once sufficiently cleaned and rinsed, the user may simply place lash cleaner 30 aside in a suitable place and allow the false lashes to dry.

Simply, the operation of the lash cleaner may be summarized as follows: normally closed; open (FIG. 1); insert false lash therein (FIG. 2); close (FIG. 5); wash (FIG. 6, etc.); rinse (FIG. 6, etc.); dry (FIG. 5); open (FIG. 2), remove false lash therefrom (FIG. 1); and close.

Figure 8:
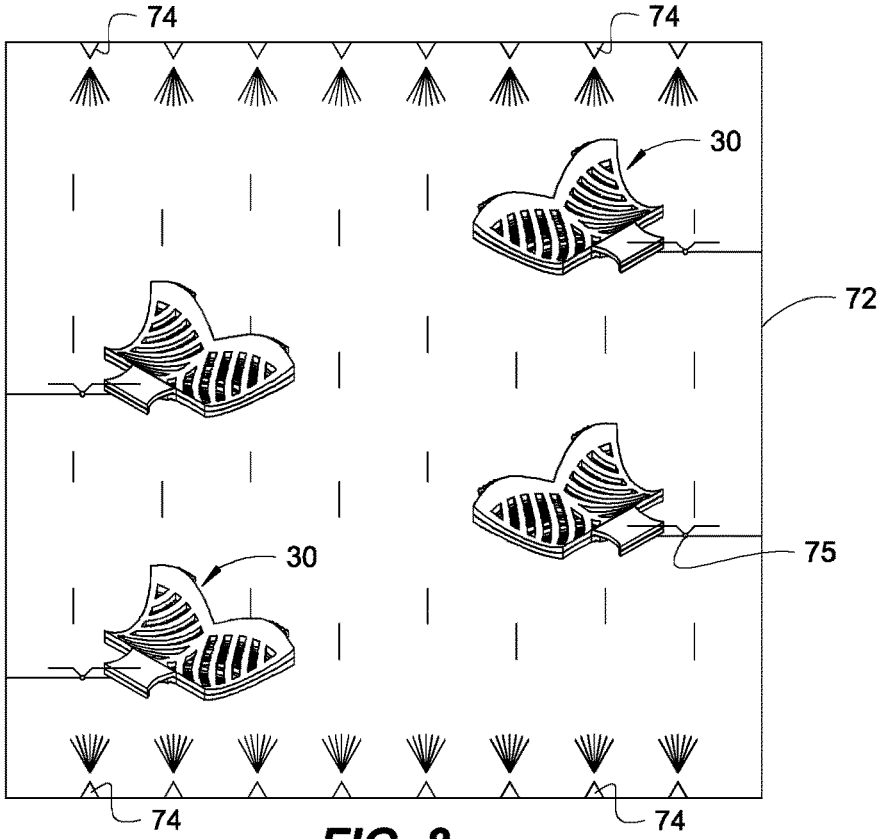
FIG. 8 is a schematic view of another exemplary method to clean false lashes.
Figure 9:
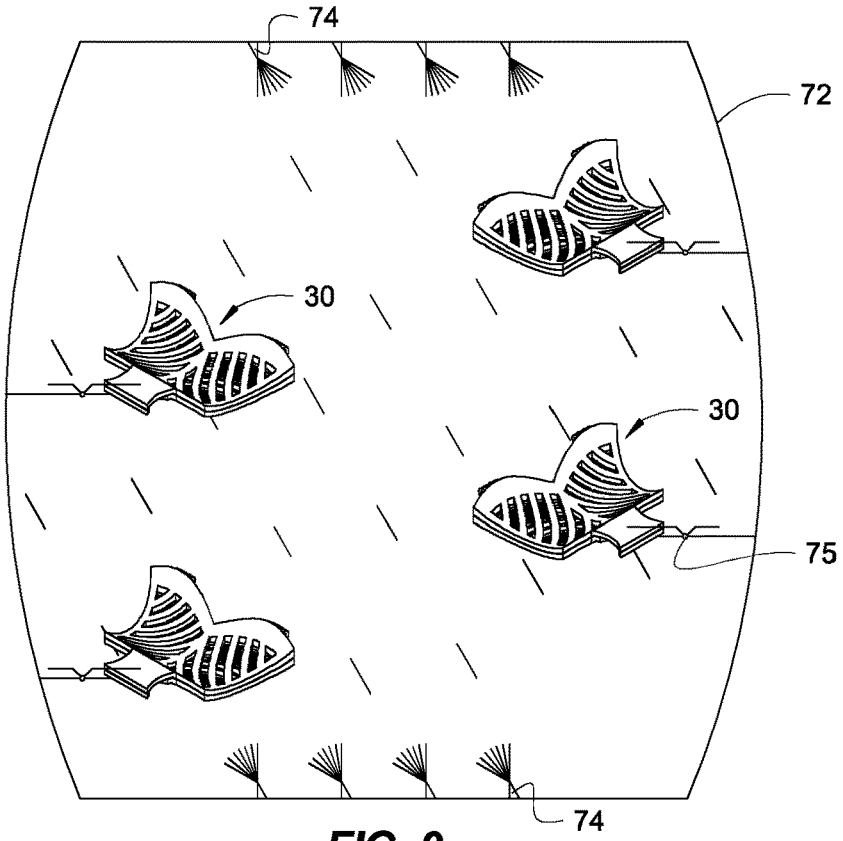
FIG. 9 is a schematic view of another exemplary method to clean false lashes.

In other embodiments, a user may place one or more lash cleaners 30 into a cleaning chamber 72 having a number of nozzles and/or jets 74 that direct water, soap, makeup remover and/or other cleaning or cleansing fluid (or combination thereof) toward the lash cleaner(s) to clean the false lashes within the lash cleaners, as shown in FIG. 8 and FIG. 9. One will appreciate that the nozzles or jets may be arranged in downward and/or upward directions to provide a rainfall-like configuration, or the nozzles and/or jets may be arranged in an angled direction to provide a whirlpool-like configuration. The cleaning chamber may be provided with clips 75 configured to secure the lash cleaners in place. Alternatively, clips may be configured to secure false lashes themselves within the cleaning chamber.

Advantageously and in accordance with various aspects of the present invention, the lash cleaner is a new, innovative product that allows false lashes to maintain their shape and integrity whilst cleansing. The lash cleaner allows for repeated, longer use of purchased false lashes, thus being cost and environmentally friendly. The lash cleaner promotes sanitary conditions and overall safety as it provides a user the ability to readily clean lashes daily, thus promoting lash cleanliness and minimizing possible eye irritation & infection.

Figure 11:
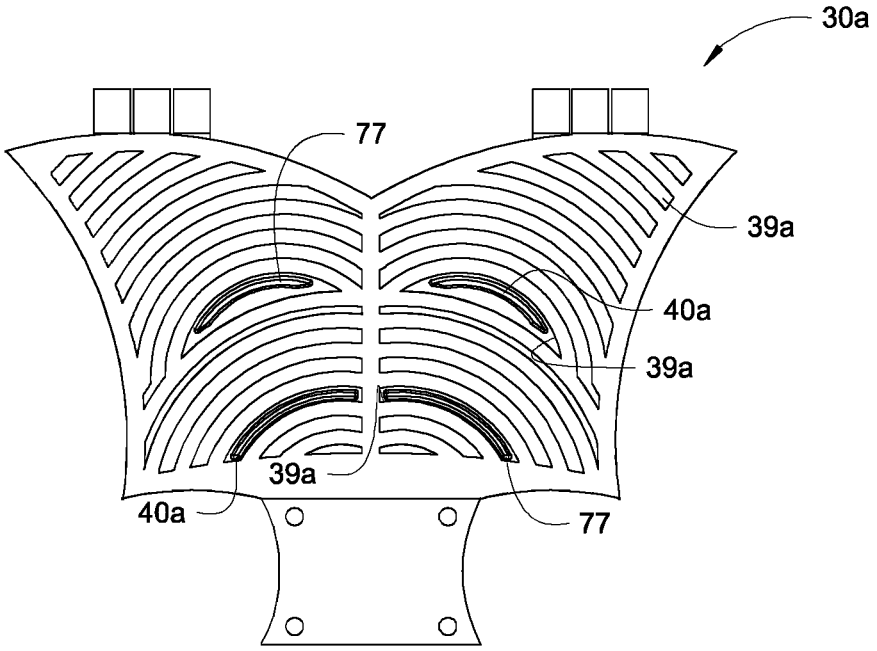
FIG. 11 is a plan view of the apparatus of FIG. 10.

Turning now to FIG. 10, lash cleaner 30*a* is similar to that described above but includes a locator 40*a* in the form of in the form of an arcuate rib or protrusion 77 extending upwardly from lower support 37*a*. As lash cleaner 30*a* does not include recesses in the lower support, it also lacks an arcuate wall surface. Thus, the arcuate protrusion provides a surface against which a user may position the strip of a false lash. Preferably, upper support 35*a* includes an aperture 39*a* that is substantially aligned with the protrusion such that the protrusion can extend into the aperture when the supports are in the closed position, as is shown in FIG. 11. In the illustrated embodiment, four protrusions are provided with four aligned apertures.

One will appreciate that upper and lower supports 35*a*, 37*a*, may be configured and dimensioned such that a false lash positioned against protrusion 77 is pinched directly between the inner surfaces both upper and lower supports 35*a*, 37*a*, thus obviating the need for a discreet holder.

Figure 13:
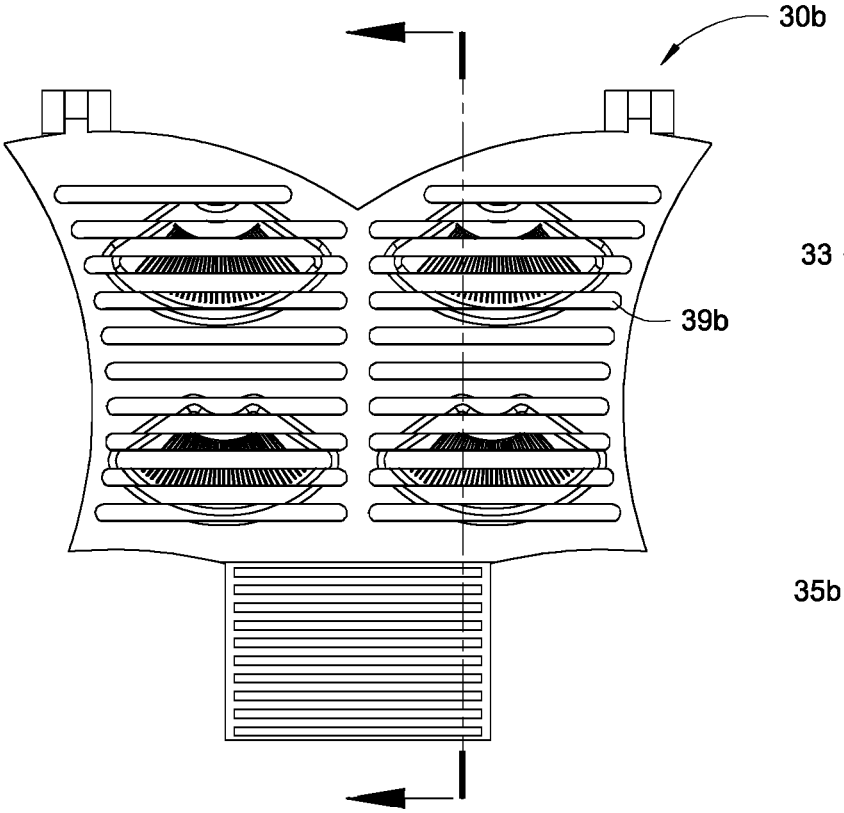
FIG. 13 is a plan view of the apparatus of FIG. 12.
Figure 14:
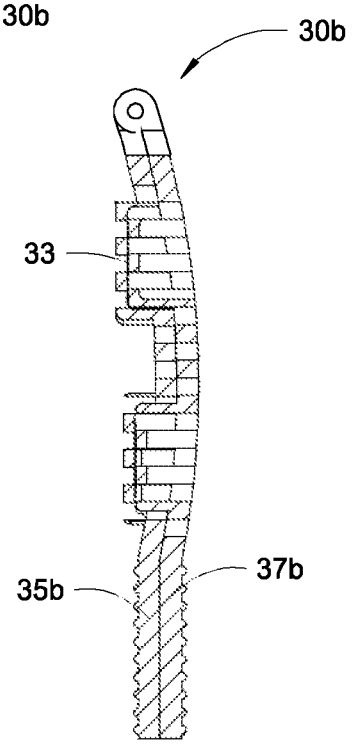
FIG. 14 is a cross-sectional view of the apparatus of FIG. 12 taken along line 14-14 in FIG. 13.

Turning to FIG. 12, the upper and lower supports 35*b*, 37*b*, may be provided with complementary fan-shaped pockets 79 and fan-shaped projections 81. The pockets and projections generally have the peripheral shape or outline of a false lash 33, which may be placed on the projection in the open position as shown in FIG. 12, and pinched between the projection and the pocket in the closed position as shown in FIG. 13. Alternatively, the false lash may be placed in the pocket and similarly pinched between the pocket and projection when closed.

Like the above embodiments, the false lash is secured between the upper and lower supports such that its strands extend across one or more apertures 39*b* thus allowing the false lash to be easily cleaned and/or rinsed.

Figure 15:
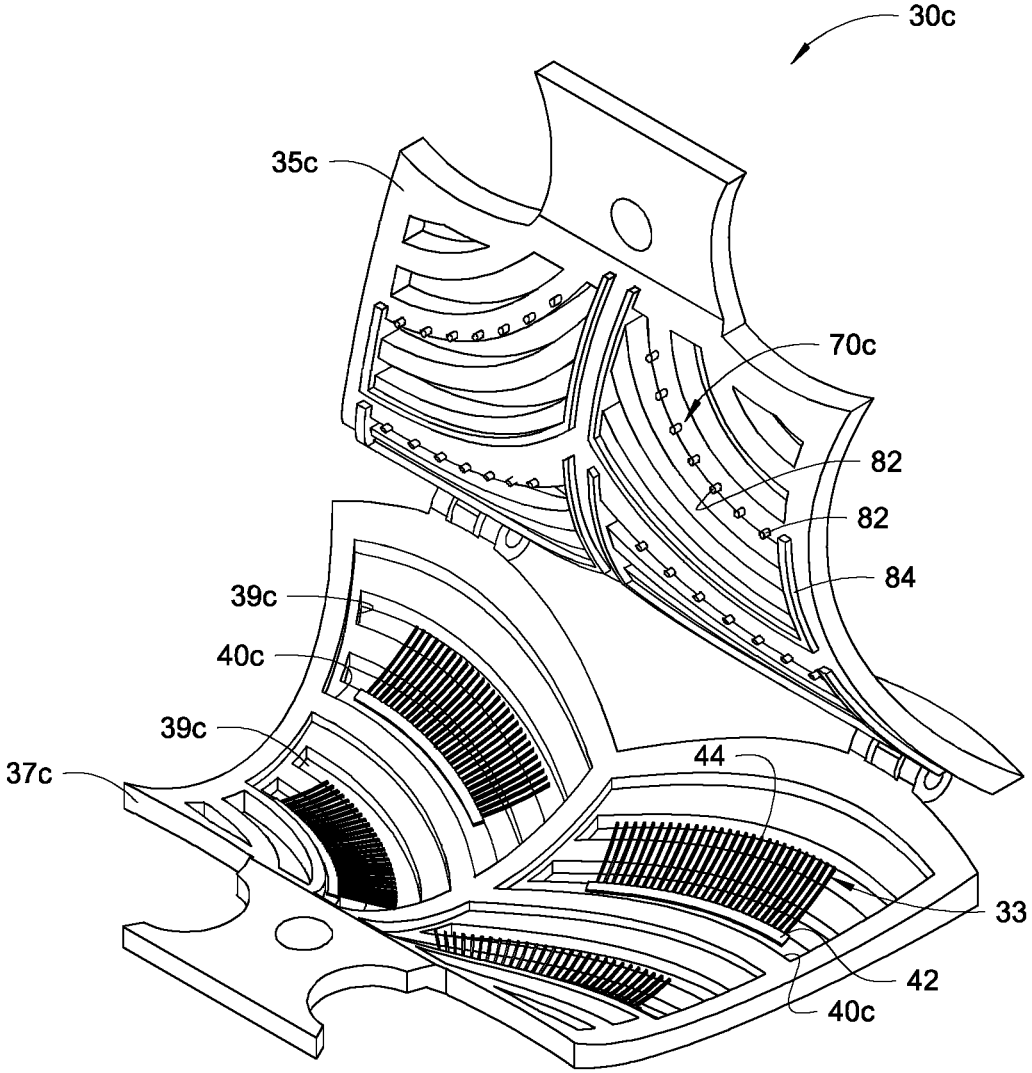
FIG. 15 is a perspective view of another apparatus for cleaning false lashes in accordance with various aspects of the present invention.

With reference to FIG. 15, in various embodiments, holder 70*c* may be in the form of holding pins 82 extending downwardly from upper support 35*c*. The holding pins may extend down and between strands 44 of false lash 33 thus entrapping strip 42 between locator 40*c* (i.e., arcuate wall surface 68) and pins 82. Such an entrapping configuration may ensure that the false lash is positioned such that its strands extend across one or more apertures to 39*c* facilitate cleaning and/or rinsing. Such an entrapping configuration may also ensure that the false lash does not inadvertently fall from body 32*c* through an aperture.

With continued reference to FIG. 15, upper support 35 may be provided with a downwardly extending flange 84 that closely approximates the outline of a corresponding recess 63*c* and extends proximal of arcuate wall surface 68*c* of the recess. The flange thusly provides an additional barrier preventing a false lash from inadvertently falling out of body 32*c* between the upper and lower supports 35*c*, 37*c*.

For convenience in explanation and accurate definition in the appended claims, the terms "upper", "lower", etc. are used to describe features of the exemplary embodiments with reference to the positions of such features as displayed in the figures.

In many respects, various modified features of the various figures resemble those of preceding features and the same reference numerals followed by subscripts "a," "b," and "c" designate corresponding parts.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A cleaning tool for cleaning false lashes, each false lash having strands extending from a strip, said cleaning tool comprising:

a body including an upper support and a lower support, wherein the upper and lower supports comprise a plurality of apertures, wherein some apertures of the plurality of apertures are located on the upper support and remaining apertures of the plurality of apertures are located on the lower support, wherein the upper and lower supports are movable relative to one another between open and closed positions, wherein the upper support is opened from the lower support to provide access to an inner surface of the lower support in the open position, and wherein the upper and lower supports substantially abut against one another in the closed position; and an arcuate locator on an inner surface of the lower support, wherein the locator positions a strip of a false lash on the lower support such that strands of the false lash extend across at least one of the plurality of apertures;

wherein the lower support, upper support, and arcuate locator are configured to fixedly secure the strip of the false lash between the upper and lower supports when the upper and lower supports are in the closed position, wherein the lower support, upper support, and arcuate locator are configured such that the strands of the false lash extend across the at least one of the plurality of apertures when the strip is fixedly secured between the upper and lower supports when the upper and lower supports are in the closed position, and wherein running fluid through the apertures of the upper and lower supports allows the fluid to run through the strands of the false lash.

2. A cleaning tool according to claim 1, further comprising a plurality of arcuate locaters projecting from the inner surface of the lower support, wherein the plurality of locaters position the respective strips of a plurality of false lashes on the lower support so that corresponding strands of the false lashes extend across at least a corresponding one of the plurality of apertures.

3. A cleaning tool according to claim 1, wherein the locater is an arcuate rib projecting from the inner surface of the lower support.

4. A cleaning tool according to claim 3, wherein at least one of the plurality of apertures in the upper support is arcuate, and wherein the arcuate rib extends into said at least one arcuate aperture of the upper support when the upper and lower supports are in the closed position.

5. A cleaning tool according to claim 1, wherein the lower support includes a recess having an arcuate wall surface, and wherein the arcuate wall surface is the arcuate locater.

6. A cleaning tool according to claim 5, wherein the recess is substantially fan-shaped and dimensioned to receive an entire false lash, and wherein the upper support includes a substantially fan-shaped projection that extends into the substantially fan-shaped recess of the lower support to trap the false lash therein when the upper and lower supports are in the closed position.

7. A cleaning tool according to claim 6, wherein one or more of the plurality of apertures extend across the fan-shaped recess, and wherein another one or more of the plurality of apertures extend across the fan-shaped projection.

8. A cleaning tool according to claim 1, further comprising a hinge interconnecting the upper and lower supports, whereby the upper support pivots open relative to the lower support when going from the closed position to the open position.

9. A cleaning tool according to claim 8, wherein a first portion of the hinge is monolithically formed with the lower support, and a second portion of the hinge is monolithically formed with the upper support.

10. A cleaning tool according to claim 1, further comprising a handle including a lower member extending from the lower support and an upper member extending from the upper support, wherein the upper and lower members contact each other when the upper and lower supports are in the closed position.

11. A cleaning tool according to claim 10, wherein the lower member is monolithically formed with the lower support, and the upper member is monolithically formed with the upper support.

12. A cleaning tool according to claim 10, wherein the handle includes a coupling to engage the upper and lower members together when the upper and lower supports are in the closed position.

13. A cleaning tool according to claim 12, wherein the coupling is a magnetic coupling with a magnet mounted in at least one of the upper and lower members.

14. A cleaning tool according to claim 1, further comprising an arcuate holder extending from an inner surface of the upper support, wherein the holder is adjacent the locator when the upper and lower supports are in the closed position to press the strip of the false lash against the inner surface of the lower support and releasably secure the false lash relative to the upper and lower supports, whereby the strip of the false lash does not move relative to the upper and lower supports when running fluid through apertures of the upper and lower supports.

15. A cleaning tool according to claim 1, wherein each of the plurality of apertures is arcuately shaped.

16. A cleaning tool according to claim 15, wherein each of the plurality of apertures is concentrically arranged with respect to an aperture.

17. A cleaning tool according to claim 15, wherein the plurality of apertures includes two or more sets of apertures, each set of apertures including a plurality of concentrically arranged apertures, and each set of apertures corresponding to a respective false lash.

18. A method for cleaning false lashes using a cleaning tool as recited in claim 1, each false lash having strands extending from a strip, said method comprising:

opening the cleaning tool such that the upper support and lower support are in the open position;

placing a false lash on the inner surface of the lower support such that the strip of the false lash is positioned against the arcuate locator on the inner surface of the lower support and strands of the false lash extend across at least one of the plurality of apertures;

closing the cleaning tool such that the false lash is fixedly secured between the lower support and the upper support; and running fluid through the apertures of the upper and lower supports such that the fluid runs through the strands of the false lash.

19. A system for cleaning one or more false lashes, each false lash having strands extending from a strip, said system comprising:

one or more cleaning tools as recited in claim 1;

a cleaning chamber sized to receive the one or more cleaning tools;

one or more clips extending from an inner surface of the cleaning chamber, wherein each clip is configured to releasably secure one of the cleaning tools within the cleaning chamber;

one or more nozzles for directing fluid within the cleaning chamber toward one or more false lashes secured within the one or more cleaning tools;

wherein the one or more nozzles direct fluid against strands of the one or more false lashes to clean or rinse the false lashes.

20. A system according to claim 19, wherein the one or more nozzles are configured to spray fluid against the one or more cleaning tools such that the fluid runs through apertures of the one or more cleaning tools and through the strands of the one or more false lashes.

* * * * *